US008408182B2

(12) United States Patent
Tsunooka et al.

(10) Patent No.: US 8,408,182 B2
(45) Date of Patent: Apr. 2, 2013

(54) CONTROL APPARATUS AND METHOD OF CONTROLLING INTERNAL COMBUSTION ENGINE MOUNTED ON VEHICLE

(75) Inventors: Takashi Tsunooka, Gotenba (JP); Yoshiyuki Shogenji, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 533 days.

(21) Appl. No.: 12/678,392

(22) PCT Filed: Oct. 21, 2008

(86) PCT No.: PCT/IB2008/002797

§ 371 (c)(1), (2), (4) Date: Mar. 16, 2010

(87) PCT Pub. No.: WO2009/053807

PCT Pub. Date: Apr. 30, 2009

(65) Prior Publication Data

US 2010/0206266 A1 Aug. 19, 2010

(30) Foreign Application Priority Data

Oct. 26, 2007 (JP) ..... 2007-278858

(51) Int. Cl.

| | |
|---|---|
| ***F02D 29/02*** | (2006.01) |
| *F02D 41/00* | (2006.01) |
| *F02D 41/16* | (2006.01) |

(52) U.S. Cl. ..... 123/339.18; 123/339.14

(58) Field of Classification Search ..... 123/339.18, 123/339.14, 339.19, 350, 352; 701/36, 38, 701/102, 110, 112, 113, 117

See application file for complete search history.

(56) References Cited

U.S. PATENT DOCUMENTS 5,497,325 A * 3/1996 Mine ..... 701/38

FOREIGN PATENT DOCUMENTS

| | | | | |
|---|---|---|---|---|
| JP | 08-074992 | A | | 3/1996 |
| JP | 10119807 | A | * | 5/1998 |
| JP | 2003-239791 | A | | 8/2003 |
| JP | 2006-046263 | A | | 2/2006 |
| JP | 2007-032320 | A | | 2/2007 |
| JP | 2009103045 | A | * | 5/2009 |
| JP | 2012132417 | A | * | 7/2012 |
| WO | 89/08776 | A1 | | 9/1989 |

* cited by examiner

*Primary Examiner* — Hieu T Vo
(74) *Attorney, Agent, or Firm* — Sughrue Mion, PLLC

(57) ABSTRACT

When an automobile is traveling on a road surface with a low friction coefficient upon a shift of an engine to idle operation in the process of stopping the automobile from traveling, a target engine speed of the engine is reduced by a value equivalent to a reduction in a drive request value for any auxiliary at a time point corresponding to start of reduction of the drive request value.

9 Claims, 4 Drawing Sheets

START OF IDLE OPERATION
VEHICLE SPEED
PREDETERMINED VALUE a
0

NUMBER OF OPERATIONS OF WATER-HEATED HEATERS
2
0
2

DRIVE REQUEST VALUE FOR ALTERNATOR

DELAY TIME
TARGET ROTATIONAL SPEED
T1
T2
T3
TIME

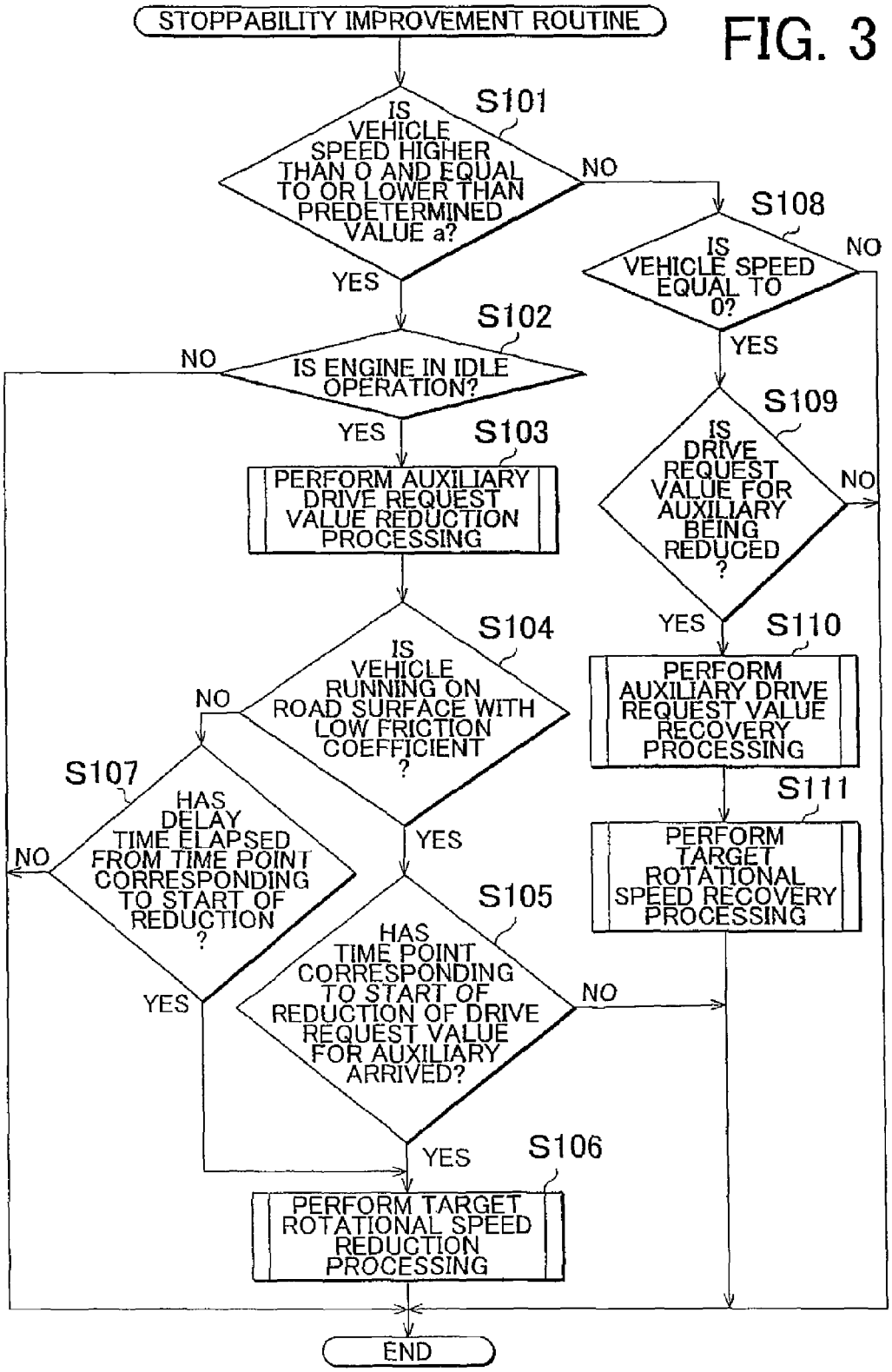
STOPPABILITY IMPROVEMENT ROUTINE
FIG. 3
S101
IS VEHICLE SPEED HIGHER THAN 0 AND EQUAL TO OR LOWER THAN PREDETERMINED VALUE a?
NO
YES
S108
IS VEHICLE SPEED EQUAL TO 0?
NO
YES
S102
IS ENGINE IN IDLE OPERATION?
NO
YES
S103
PERFORM AUXILIARY DRIVE REQUEST VALUE REDUCTION PROCESSING
S109
IS DRIVE REQUEST VALUE FOR AUXILIARY BEING REDUCED ?
NO
YES
S110
PERFORM AUXILIARY DRIVE REQUEST VALUE RECOVERY PROCESSING
S104
IS VEHICLE RUNNING ON ROAD SURFACE WITH LOW FRICTION COEFFICIENT ?
NO
YES
S107
HAS DELAY TIME ELAPSED FROM TIME POINT CORRESPONDING TO START OF REDUCTION ?
NO
YES
S111
PERFORM TARGET ROTATIONAL SPEED RECOVERY PROCESSING
S105
HAS TIME POINT CORRESPONDING TO START OF REDUCTION OF DRIVE REQUEST VALUE FOR AUXILIARY ARRIVED?
NO
YES
S106
PERFORM TARGET ROTATIONAL SPEED REDUCTION PROCESSING
END START OF IDLE OPERATION
VEHICLE SPEED
PREDETERMINED VALUE a
0

NUMBER OF OPERATIONS OF WATER-HEATED HEATERS
2
1
0

DRIVE REQUEST VALUE FOR ALTERNATOR

TARGET ROTATIONAL SPEED
T4
T5
TIME

CONTROL APPARATUS AND METHOD OF CONTROLLING INTERNAL COMBUSTION ENGINE MOUNTED ON VEHICLE

BACKGROUND OF THE INVENTION

1. Field of the Invention

The invention relates to a control apparatus and a method of controlling an internal combustion engine mounted on a vehicle.

2. Description of the Related Art

In an internal combustion engine mounted on a vehicle such as an automobile or the like, if the speed of the vehicle is equal to or below a predetermined speed to make a shift to idle operation in the process of stopping the vehicle from traveling, an idle speed control for adjusting the engine speed to a target engine speed during idle operation is performed. The target rotational speed used in this idle rotational speed control is variably set in accordance with the magnitude of a driving request for an auxiliary driven by the internal combustion engine. The target rotational speed is set higher as the driving request for the auxiliary increases. The target rotational speed is thus made variable in accordance with the magnitude of the driving torque for the auxiliary because as the driving torque for the auxiliary increases, the rotational resistance acting on the internal combustion engine during the driving of the auxiliary increases and the occurrence of a stall resulting from the increased rotational resistance during idle operation needs to be suppressed.

In the case where the driving request for the auxiliary is large when the speed of the vehicle becomes equal to or lower than the predetermined value to make a shift of engine operation to idle operation in the process of stopping the vehicle from traveling through the actuation of a brake, the target rotational speed for idle rotational speed control is set high, and the rotational speed of the engine during idle operation is also set high accordingly. In this case, since the rotational speed of the engine during idle operation is high as described above, the driving force applied to driving wheels of the vehicle is large. The rotational speed of the driving wheels is unlikely to be reduced even when a braking force is applied to the driving wheels by means of the brake. As a result, it takes some time to stop the vehicle from traveling.

To cope with this situation, it is conceivable to prevent a driving force from being applied to the driving wheels of the vehicle by holding a transmission in a neutral state as disclosed in Japanese Patent Application Publication No. 8-74992 (JP-A-8-74992) (paragraphs [0032] to [0034]) in the process of stopping the vehicle from traveling. In this case, even if the rotational speed of the engine is adjusted to the target rotational speed that has been set high when the speed of the vehicle becomes equal to or lower than the predetermined speed to make a shift of engine operation to idle operation, the driving force based on the rotation of the engine at that moment is not transmitted to the driving wheels. It is thus assumed that the vehicle can be swiftly stopped from traveling after the shift to idle operation. However, in the process of stopping the vehicle from traveling before the shift to idle operation, the transmission is held in the neutral state to shut off a transmission path of the driving force between the driving wheels and the internal combustion engine. As a result, the rotational resistance of the internal combustion engine does not serve as a braking force for the driving wheels. It is therefore demanded to ensure the braking force for swiftly stopping the vehicle from traveling by using the brake alone. However, such a braking force cannot always be ensured by using the brake alone. It takes some time to stop the vehicle from traveling when the braking force cannot be ensured with ease.

Further, instead of holding the transmission in the neutral state in the process of stopping the vehicle from traveling, it is also conceivable to reduce the driving request for the auxiliary to reduce the target rotational speed for idle rotational speed control upon a shift of engine operation to idle operation, reduce the rotational speed of the engine during idle operation on the basis of the reduced target rotational speed, and hence make the driving force applied to the driving wheels small on the basis of the rotation of the engine. In this case, in the process of stopping the vehicle from traveling before the shift to idle operation, the rotational resistance of the internal combustion engine serves as a braking force for the driving wheels. Thus, the braking force for swiftly stopping the vehicle from traveling is applied to the driving wheels through the rotational resistance of the internal combustion engine and the brake. Further, after the shift of engine operation to idle operation in the process of stopping the vehicle from traveling, the drive request value for the auxiliary is reduced to reduce the target rotational speed used for idle rotational speed control. The driving force applied to the driving wheels can thereby be made small. Owing to the foregoing procedure, the vehicle is swiftly stopped from traveling.

As described above, when a shift of engine operation to idle operation is made in the process of stopping the vehicle from traveling, the drive request value for the auxiliary is reduced to thereby reduce the target rotational speed for idle rotational speed control. Thus, the vehicle is swiftly stopped from traveling.

In normal idle rotational speed control, however, a predetermined delay time is set between a time point corresponding to reduction of the drive request value for the auxiliary as described above and a time point corresponding to actual reduction of the target rotational speed. Accordingly, when the drive request value for the auxiliary is reduced, the target rotational speed is not reduced until the lapse of the predetermined delay time from a time point corresponding to the start of reduction of the drive request value for the auxiliary. The target rotational speed is reduced after the lapse of the delay time.

This delay time is set because of the following reason. That is, when the drive request value for the auxiliary is reduced, the rotational speed of the engine during idle operation may be reduced with the drive rate of the auxiliary not having been reduced completely, unless the target rotational speed is restrained from being reduced in response to the reduction in the drive request value for a time needed (equivalent to the delay time) to ensure a reduction in the drive rate of the auxiliary resulting from the reduction in the drive request value. If the rotational speed of the engine during idle operation is reduced with the drive rate of the auxiliary not having been reduced completely, reduction of the rotational speed of the engine occurs with high rotational resistance for driving the auxiliary, which acts on the internal combustion engine. At this moment, there is a disturbance acting on the driving wheels in such a direction as to stop rotation thereof. For example, an external force (a frictional force or the like) from a road surface side is applied to the driving wheels reversely to the rotational direction thereof. In that case, the internal combustion engine may undergo a stall as a result of a further reduction in the rotational speed of the engine caused by the disturbance. The occurrence of a stall of the internal combustion engine in a situation as described above is suppressed by setting the delay time.

However, when the predetermined delay time is set between the time point corresponding to reduction of the drive request value for the auxiliary and the time point corresponding to reduction of the target rotational speed for idle rotational speed control in response thereto upon a shift of engine operation to idle operation in the process of stopping the vehicle from traveling, the time needed to stop the vehicle from traveling is prolonged by the delay time. As a result, it is difficult to swiftly stop the vehicle from traveling. Further, it is also conceivable to shorten the delay time giving higher priority to the swift stoppage of the traveling of the vehicle than to the suppression of the occurrence of a stall of the internal combustion engine. In this case, however, the possibility of the internal combustion engine undergoing a stall inevitably becomes high.

SUMMARY OF THE INVENTION

The invention provides a control apparatus and a method of controlling an internal combustion engine mounted on a vehicle that stop the vehicle from traveling as swiftly as possible while suppressing the stalling of the internal combustion engine upon a shift of engine operation to idle operation in the process of stopping the vehicle from traveling.

In a first aspect of the invention, a control apparatus for an internal combustion engine mounted on a vehicle that executes an engine idle speed control for adjusting the engine speed to a target engine speed set in accordance with a magnitude of a drive request value for an auxiliary driven by the internal combustion engine when the vehicle speed is equal to or below a predetermined speed to idle the internal combustion engine, in a process of stopping the vehicle from traveling, reduces the drive request value for the auxiliary during performance of the engine idle speed control, and reduces the target engine speed by a value equivalent to a reduction in the drive request value after lapse of a prescribed delay time from a time point corresponding to start of reduction of the drive request value. The control apparatus includes detection means for detecting whether the vehicle is traveling on a road surface with low friction coefficient, and engine speed reduction means for reducing the target engine speed by the value equivalent to the reduction in the drive request value before lapse of the delay time if it is determined that the vehicle is traveling on a road surface with low friction coefficient.

If the speed of the vehicle is equal to or below the predetermined speed to idle the internal combustion engine mounted on the vehicle in the process of stopping the vehicle from traveling, the target engine speed for the engine idle speed control is reduced by the value equivalent to the reduction in the drive request value for the auxiliary based on the reduction of the drive request value. Thus, the vehicle is swiftly stopped from traveling. If the vehicle is traveling on a road surface with low friction coefficient upon a shift of the internal combustion engine to the idle operation, even if the target engine speed is reduced by the value equivalent to the reduction in the drive request value for the auxiliary after the drive request value is reduced and before the delay time elapses, the internal combustion engine is unlikely to stall. This is because there is a small amount of disturbance acting on driving wheels in such a direction as to stop rotation thereof on a road surface with low friction coefficient. For example, a relatively small external force (a relatively small frictional force or the like) from the road surface side acts on the driving wheels opposite the rotational direction thereof on a road surface with a low friction coefficient. As a result, the engine speed is hardly reduced due to the disturbance. According to the foregoing configuration, if the vehicle is traveling on a road surface with low friction coefficient, the target engine speed is reduced by the value equivalent to the reduction in the drive request value for the auxiliary before the lapse of the delay time as described above. If the vehicle is not traveling on a road surface with low friction coefficient, the target engine speed is reduced after the lapse of the delay time. Thus, the vehicle may be stopped as swiftly as possible while suppressing the occurrence of a stall of the internal combustion engine upon a shift of engine operation to idle operation in the process of stopping the vehicle from traveling.

In the first aspect of the invention, the engine speed reduction means may reduce the target engine speed by the value equivalent to the reduction in the drive request value for the auxiliary, from a time point corresponding to start of reduction of the drive request value.

According to the foregoing configuration, if the drive request value for the auxiliary is reduced when engine shifts to idle operation in the process of stopping the vehicle on a road with low friction coefficient, the target engine speed for the engine idle speed control is reduced by the value equivalent to the reduction in the drive request value from the time point corresponding to the start of reduction of the drive request value used. Therefore, the engine speed may be swiftly reduced during the idle operation. Thus, the vehicle may be more swiftly stopped from traveling.

In the first aspect of the invention, the engine speed reduction means may gradually reduce the drive request value for the auxiliary, and also gradually reduce the target engine speed in a manner corresponding to reduction of the drive request value.

If the drive request value for the auxiliary is large when a shift of engine operation to idle operation is made in the process of stopping the vehicle, the target engine speed is also high. Therefore, the drive request value for the auxiliary is drastically reduced, and the target engine speed is rapidly and drastically reduced on the basis of the reduction in the drive request value. In this case, if the drive rate of the auxiliary cannot be reduced in good response to the drastic reduction in the drive request value for the auxiliary, the internal combustion engine may stall if the target engine speed is reduced by the value equivalent to the reduction in the drive request value before the lapse of the delay time when the vehicle is traveling on a road with low friction coefficient. This is because high rotational resistance is produced in the internal combustion engine to drive the auxiliary during a period of a response delay in reducing the drive rate of the auxiliary, and the target engine speed is drastically reduced at once by the value equivalent to the drastic reduction in the drive request value for the auxiliary in such a state. According to the foregoing configuration, in a situation where a response delay is caused in reduction of the drive rate of the auxiliary for reduction of the drive request value for the auxiliary when the drive request value is large, the drive request value for the auxiliary is gradually reduced, and consequently, the target engine speed is also gradually reduced. Thus, when high rotational resistance for driving the auxiliary is produced in the internal combustion engine in the period in which there is a response delay in reduction of the drive rate of the auxiliary for reduction of the drive request value for the auxiliary, the target engine speed may be restrained from being drastically reduced, and the internal combustion engine can be restrained from stalling due to a drastic reduction in the target engine speed.

In the first aspect of the invention, the auxiliary may be an alternator that gereates power in accordance with a number of operations of electric heaters, and gradually reduce the number of operations of the electric heaters to reduce a drive request value for the alternator, and the engine speed reduction means may gradually reduce the target engine speed based on the reduction of the number of operations of the electric heaters.

The electric heaters require a large amount of power. Therefore, when the number of operations of the electric heaters is large, the drive request value for the alternator is large. The amount of power generation (drive rate) of the alternator is also large on the basis of the large drive request value. Therefore, the rotational resistance at the time when the internal combustion engine drives the alternator is high as well. According to the foregoing configuration, when a shift of engine operation to idle operation is made in the process of stopping the vehicle, the number of operations of the electric heaters is gradually reduced to gradually reduce the drive request value for the alternator. In addition, the target engine speed during the idle operation is also gradually reduced based on the gradual reduction of the number of operations of the electric heaters. Accordingly, if a response delay is caused in reducing the drive rate of the alternator for reduction of the drive request value for the alternator and high rotational resistance for driving the alternator is produced in the internal combustion engine during a period in which the response delay is caused, the target engine speed is not drastically reduced. Accordingly, the internal combustion engine can be restrained from stalling as a result of a drastic reduction in the target engine speed.

In the first aspect of the invention, the auxiliary may be an alternator that generates power in accordance with a number of operations of electric heaters, and gradually reduce the number of operations of the electric heaters to reduce a drive request value for the alternator, and the engine speed reduction means may gradually reduce the target engine speed based on the reduction of the drive rate of the alternator resulting from reduction of the drive request value.

The electric heaters require a large amount of power. Therefore, when the number of operations of the electric heaters is large, the drive request value for the alternator is large. The amount of power generation (drive rate) of the alternator is also large on the basis of the large drive request value. Therefore, the rotational resistance at the time when the internal combustion engine drives the alternator is high as well. According to the foregoing configuration, when a shift of engine operation to idle operation is made in the process of stopping the vehicle, the number of operations of the electric heaters is gradually reduced to gradually reduce the drive request value of the alternator. In addition, the target engine speed during the idle operation is also gradually reduced based on the drive rate of the alternator that is gradually reduced as the drive request value for the alternator is gradually reduced as described above. Accordingly, if a response delay is caused in reducing the drive rate of the alternator for reduction of the drive request value for the alternator and high rotational resistance for driving the alternator is produced in the internal combustion engine during a period in which the response delay is caused, the target engine speed is not drastically reduced. Accordingly, the internal combustion engine can be restrained from stalling as a result of a drastic reduction in the target engine speed.

In a second aspect of the invention, there is provided a control method for an internal combustion engine mounted on a vehicle. In the control method, engine idle speed control is executed to adjust the engine speed to a target engine speed set in accordance with a magnitude of a drive request value for an auxiliary driven by the internal combustion engine when a speed of the vehicle is equal to or below a predetermined speed to idle the internal combustion engine, in a process of stopping the vehicle from traveling, the drive request value for the auxiliary is reduced when executing the engine idle speed control, and the target engine speed is reduced by a value equivalent to a reduction in the drive request value after lapse of a prescribed delay time from a time point corresponding to start of reduction of the drive request value. The control method includes determining whether the vehicle is traveling on a road surface with low friction coefficient, and reducing the target engine speed by the value equivalent to the reduction in the drive request value before lapse of the delay time if it is determined that the vehicle is traveling on a road surface with low friction coefficient.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 3 is a flowchart showing the execution of a process for enhancing the stoppability of the automobile to swiftly bring the automobile to a stop from traveling.

DETAILED DESCRIPTION OF EMBODIMENTS

The first embodiment in which the invention is applied to an engine mounted on a rear-wheel-drive automobile will be described hereinafter with reference to FIGS. 1 to 3.

Figure 1:
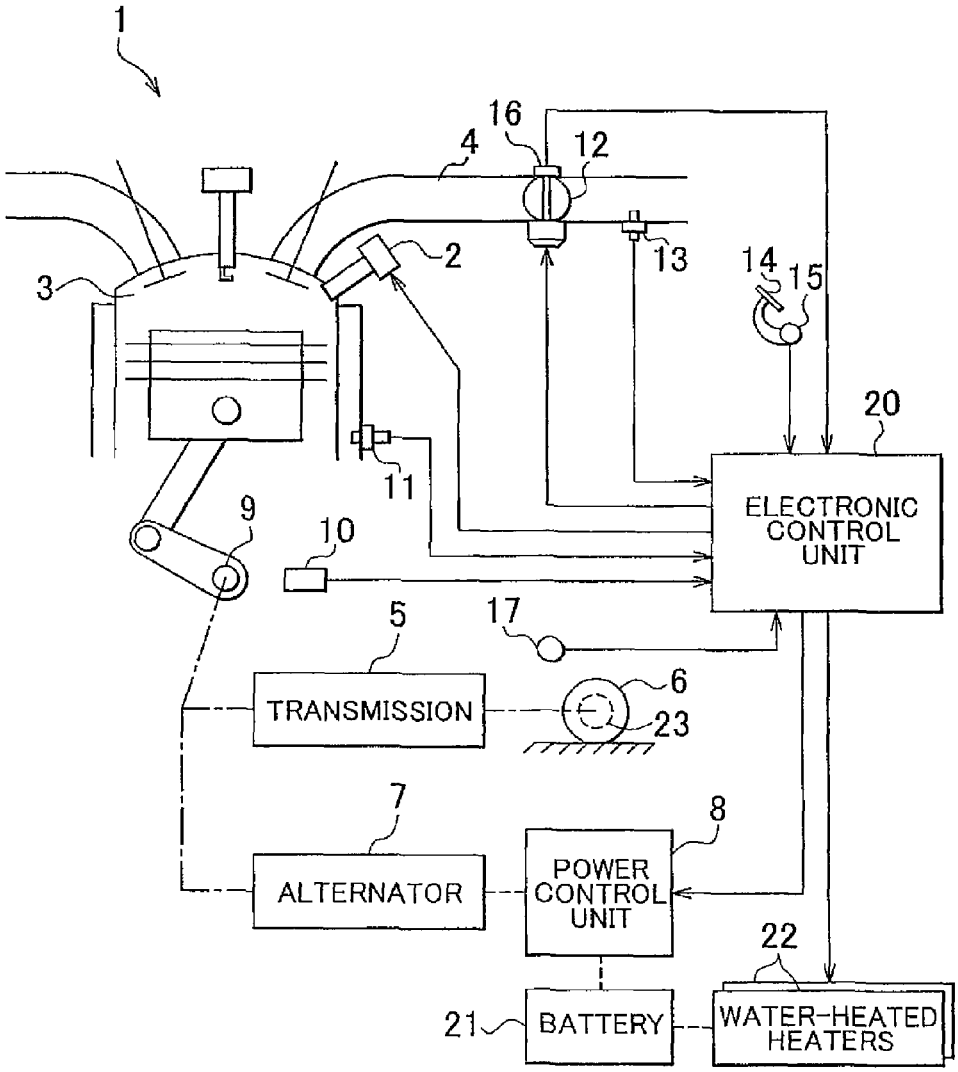
FIG. 1 is a schematic diagram showing an entire engine to which a control apparatus according to the first embodiment of the invention is applied.

In an engine 1 shown in FIG. 1, air is drawn from an intake passage 4 into a combustion chamber 3, and an amount of fuel appropriate for this intake air amount is injected from a fuel injection valve 2 and supplied to the combustion chamber 3. Thus, as the amount of intake air increases through the adjustment of the opening degree of a throttle valve 12 provided in the intake passage 4, the amount of the mixture burned in the combustion chamber 3 increases and the power output of the engine increases. A crankshaft 9 as an output shaft of the engine 1 is connected to the driving wheels (rear wheels) 6 of the automobile via a drive train that includes a transmission 5 such as an automatic transmission or the like. A brake 23 applies a braking force to the driving wheels 6 for stopping the rotation of the driving wheels 6. Further, various auxiliaries such as an alternator 7, a compressor for an air-conditioner, and the like are also connected to the crankshaft 9.

The alternator 7 is one of the various auxiliaries driven by the engine 1 and is electrically connected to a battery 21 via a power control unit 8, and the operation of the alternator 7 is controlled through the unit 8. The alternator 7 then generates power based on the rotation of the crankshaft 9. The generated alternating-current power is converted into direct-current power through the power control unit 8 and then stored in the battery 21. At this moment, the amount of power generation (the drive rate of the alternator 7) is adjusted by adjusting the voltage applied to an exciting coil of a rotor of the alternator 7 through the power control unit 8.

Various electric components mounted on the automobile are supplied with power generated by the alternator 7. That is, the various electric components of the automobile are supplied with a power from the alternator 7 and the battery 21 through the power control unit 8, and are driven on the basis of the power thus supplied. The various electric components of the automobile may include are a plurality of (two in this embodiment of the invention) water-heated heaters 22 that are energized/heated to heat coolant for the engine 1 when the coolant is in a much cooled state, an electric motor for a power steering device, an electric heating element for windows, and the like.

The automobile is equipped with an electronic control unit 20 that executes various controls regarding the engine 1, the transmission 5, and the like. The electronic control unit 20 is configured with a CPU that executes various calculation processes regarding the various controls, a ROM in which programs and data required for the various types of control are stored, a RAM in which the calculation results of the CPU and the like are temporarily stored, input/output ports for inputting/outputting signals to/from the outside, and the like.

Various sensors, which will be described below, are connected to the input port of the electronic control unit 20. The sensors include an accelerator position sensor 15 for detecting the depression amount of an accelerator pedal 14 (accelerator depression amount) that is operated by a driver of the automobile, a throttle position sensor 16 for detecting an opening degree of the throttle valve 12 (throttle opening degree), an airflow meter 13 for detecting the flow rate of air drawn into the combustion chamber 3 via the intake passage 4 (intake air flow rate), a crank position sensor 10 that outputs a signal indicating the rotation of the crankshaft 9 as the output shaft of the engine 1, a coolant temperature sensor 11 for detecting a temperature of coolant for the engine 1, and a vehicle speed sensor 17 for detecting the vehicle speed. Drive circuits for the fuel injection valve 2, the throttle valve 12, and the like are connected to an output port of the electronic control unit 20.

The electronic control unit 20 outputs a command signal to each of the drive circuits for the respective components that are connected to the output port, in accordance with an engine operation state determined based on the detection signals received from the respective sensors. The electronic control unit 20 thus executes various controls such as the control of the amount of fuel injected from the fuel injection valve 2, the control of the opening degree of the throttle valve 12, the control of energization of the water-heated heaters 22, the control of the driving of the alternator 7 (the power control unit 8), and the like.

Next, the control of the opening degree of the throttle valve 12 by the electronic control unit 20 will be described in detail. The opening degree of the throttle valve 12 is controlled based on a throttle opening degree command value TAt through the electronic control unit 20. This throttle opening degree command value TAt is calculated using an expression (1) shown below.

$$TAt = TA\text{base} + Q\text{cal} \cdot kt \quad (1)$$

(TAbase: base throttle opening degree, Qcal: ISC correction amount, kt: conversion coefficient)

In expression (1), the base throttle opening degree TAbase is calculated based on an accelerator depression amount that is calculated based on the detected accelerator position, an engine speed calculated based on the detected crank position, and the like. The base throttle opening degree TAbase is set to "0" if the engine 1 is idling. The term "Qcal·kt" in the expression (1) is provided to execute an engine idle speed control, namely, the control of the engine speed during idle operation.

The throttle opening degree command value TAt when the engine is idling is determined by the term "Qcal·kt" because the base throttle opening degree TAbase is "0". In this term "Qcal·kt", the ISC correction amount Qcal is a dimensionless parameter that is increased/reduced to adjust the engine speed during the engine idle speed control, and the conversion coefficient kt serves to convert the ISC correction amount Qcal into the throttle opening degree as a parameter. In the engine idle speed control, the ISC correction amount Qcal is increased/reduced in accordance with the deviation in the engine speed from the set target engine speed to ensure that the engine speed approaches the target engine speed.

That is, if the engine speed is below the target engine speed, the ISC correction amount Qcal is increased to increase the opening degree of the throttle valve 12. When the opening degree of the throttle valve 12 is thus increased to increase the amount of intake air in the engine 1, the amount of fuel injection is increased accordingly, and the engine speed is increased toward the target engine speed. Further, if the engine speed is higher than the target engine speed, the ISC correction amount Qcal is reduced to reduce the opening degree of the throttle valve 12. When the opening degree of the throttle valve 12 is thus reduced to reduce the amount of intake air in the engine 1, the fuel injection amount is reduced accordingly, and the engine speed is reduced to the target engine speed.

The engine speed during idle operation is adjusted to the target engine speed by performing engine idle speed control as described above. Further, the target engine speed for the engine idle speed control may be variably set in accordance with the temperature of the coolant for the engine 1, the magnitudes of drive request values for various auxiliaries driven by the engine 1, and the like. For example, this target engine speed is increased with increases in the drive request value for each of the auxiliaries, and conversely, is reduced with decreases in the drive request value. This is because of the purpose of restraining a stall from occurring during idle operation as a result of rotational resistance acting on the engine 1 when driving any of the auxiliaries, which increases as the drive request value for each of the auxiliaries increases.

Figures 2A, 2B, 2C, 2D:
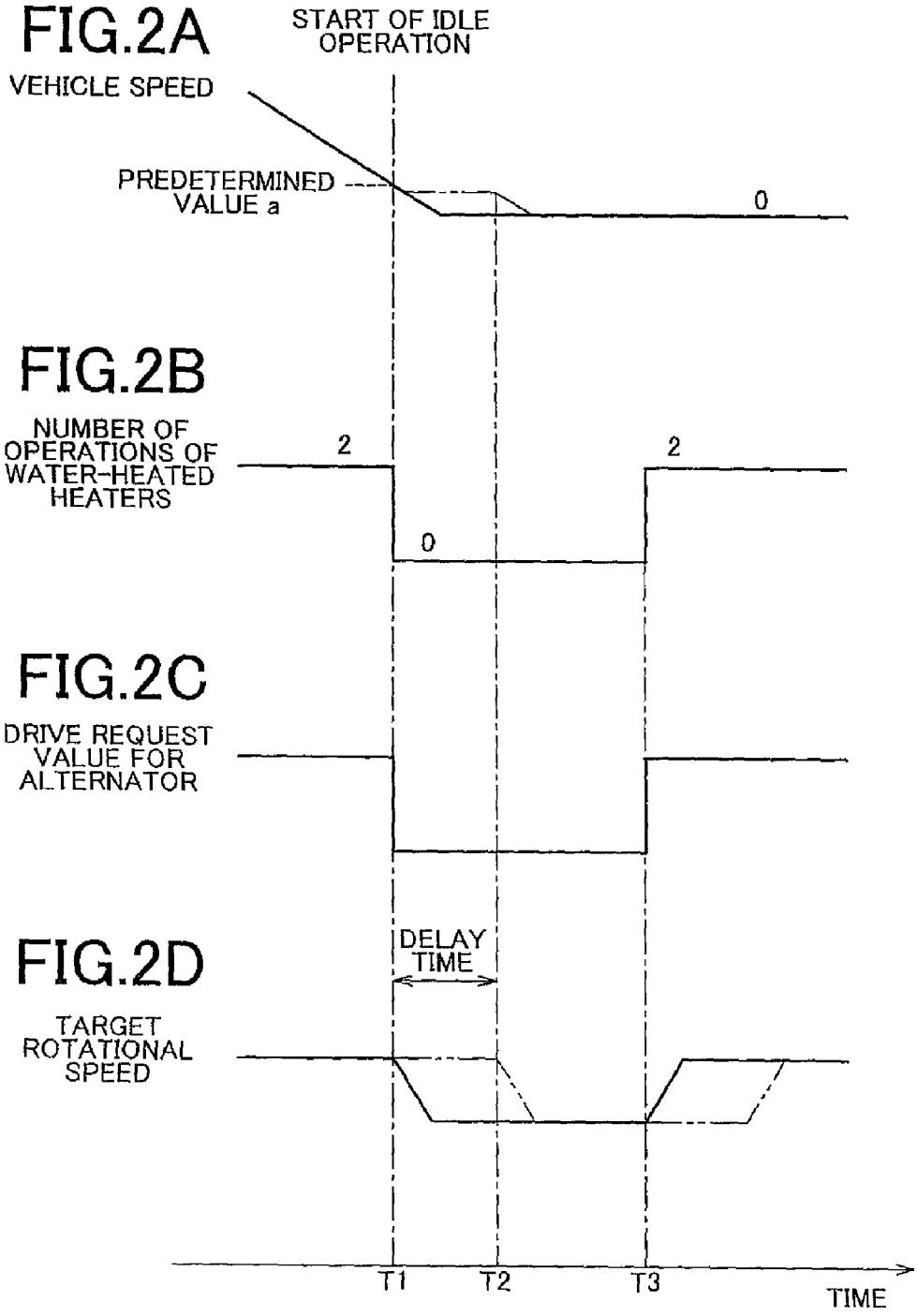
FIGS. 2A to 2D are time charts showing changes in vehicle speed, number of operations of water-heated heaters, driving request value for an alternator, and target rotational speed respectively when brining an automobile traveling to a stop.

Next, the engine idle speed control that is executed when bringing the automobile to a halt will be described with reference to time charts of FIGS. 2A to 2D. In the process of stopping the automobile from traveling through the actuation of the brake 23 or the like, if the vehicle speed is equal to or below a predetermined speed, which is close to "0", to make a shift of the engine 1 to idle operation (at a timing T1) as shown in FIG. 2A, the engine idle speed control is executed. If the drive request value for each of the auxiliaries is large during the execution of engine idle speed control as described above, the engine idle speed control sets a high target engine speed. As a situation where the drive request value for each of the auxiliaries is large as described above, it is possible to mention, for example, a situation where all the (two) water-heated heaters 22 are in operation as a result of too low a temperature of the coolant for the engine 1 and the drive request value for the alternator 7 (power generation request value) is large.

If the target engine speed for engine idle speed control is set high as a result of a large drive request value for the auxiliary (the alternator 7 in this example) during a shift to the idle operation, the engine speed during idle operation is also set high. Thus, when the engine speed during the idle operation increases, the driving force applied to the driving wheels 6 of the automobile at that moment increases. Even when a braking force is applied to the driving wheels 6 by the brake 23, the rotational speed of the driving wheels 6 is unlikely to be reduced, and it takes some time to stop the automobile from traveling.

To cope with this problem, the drive request value for the auxiliary (the alternator 7) is reduced during a shift to the idle operation. The target engine speed for the engine idle speed control is reduced by a value equivalent to a reduction in the drive request value. More specifically, for example, the number of operations of the water-heated heaters 22 is reduced from "2" to "0" as shown in FIG. 2B. The drive request value for the alternator 7 is thereby reduced as shown in FIG. 2C, and the target engine speed is reduced by the value equivalent to a reduction in the drive request value. In normal engine idle speed control, however, if the drive request value for the auxiliary is reduced as described above, a predetermined delay time (between the timing T1 and a timing T2) is set between a time point corresponding to the start of reduction of the drive request value and a time point corresponding to actual reduction of the target engine speed. Accordingly, when the drive request value for the auxiliary is reduced, the target engine speed is not reduced as indicated by alternate long and two short dashes lines in FIG. 2D until the lapse of the predetermined delay time (T1~T2) from the time point corresponding to the start of reduction of the drive request value. The target engine speed starts to decrease after the lapse of the delay time.

The delay time is set because of the following reason. That is, if the drive request value for the auxiliary is reduced, the reduction of the target engine speed as a result of the reduction in the drive request value needs to be delayed, for the time needed (equivalent to the delay time) to ensure a reduction in the drive rate of the auxiliary resulting from a reduction in the drive request value. Otherwise the engine speed during idle operation may be reduced before the drive rate of the auxiliary is reduced completely. The delay time in the first embodiment of the invention is set to, for example, 3 seconds as the time needed to ensure a reduction in the drive rate of the auxiliary resulting from a reduction in the drive request value for the auxiliary when the drive request value is reduced as described above. If the engine speed during idle operation is reduced before the drive rate of the auxiliary is reduced completely, reduction of the engine speed occurs while high rotational resistance for driving the auxiliary acts on the engine 1. At this moment, if there is a disturbance acting on the driving wheels 6 in such a direction as to stop rotation thereof, for example, when an external force (a frictional force or the like) from a road surface side is applied to the driving wheels 6 reversely to the rotational direction thereof, a further reduction in the engine speed is caused by the disturbance. Thus, the engine 1 may stall. The stalling of the engine 1 in a situation as described above is suppressed by setting the delay time.

However, when the delay time (T1~T2) is set, the speed of the vehicle is unlikely to be reduced during the lapse of the delay time as indicated by alternate long and two short dashes lines in FIG. 2A. As a result, it takes a long time to bring the speed of the vehicle equal to "0" to stop the automobile from traveling. It is therefore difficult to swiftly stop the automobile from traveling.

Thus, in the first embodiment of the invention, if the automobile is traveling on a road surface with low friction coefficient, the target engine speed is reduced in accordance with a reduction in the drive request value for the auxiliary before the lapse of the delay time (T1~T2). More specifically, the target engine speed is reduced by a value equivalent to a reduction in the drive request value, from a time point corresponding to the start of reduction of the drive request value, as indicated by a solid line in FIG. 2D, before the delay time (T1~T2) has elapsed.

If the automobile is traveling on a road surface with low friction coefficient upon a shift of the engine 1 to idle operation in the process of stopping the automobile from traveling, even if reduction of the target engine speed by the value equivalent to the reduction in the drive request value is started after the drive request value for the auxiliary is reduced and before the delay time elapses (at the time point corresponding to the start of reduction of the drive request value in this example), the engine 1 is unlikely to stall. On a road surface with low friction coefficient, there is a little influence of a disturbance on the driving wheels 6 in such a direction as to stop rotation thereof. For example, a relatively small external force from the road surface side is applied to the driving wheels 6 reversely to the rotational direction thereof. Thus, the engine speed is hardly reduced due to the disturbance.

Accordingly, if the automobile is traveling on a road surface with low friction coefficient, the target engine speed is reduced from the time point (T1) corresponding to the start of reduction of the drive request value for the auxiliary as described above. Thus, while the engine 1 is restrained from stalling, the speed of the vehicle is swiftly made equal to "0" to stop the automobile from traveling, as indicated by the solid line in FIG. 2A. Further, if the automobile is not traveling on a road surface with low friction coefficient, the target engine speed is reduced after the lapse of the delay time (T1~T2) from the time point corresponding to the start of reduction of the drive request value for the auxiliary. The engine 1 is thereby appropriately restrained from stalling. Owing to the foregoing procedure, the automobile may be stopped from traveling as swiftly as possible while suppressing stalling of the engine 1 upon a shift of the engine 1 to idle operation in the process of stopping the automobile from traveling.

Next, a procedure of executing processes for swiftly stopping the automobile from traveling as described above will be described in detail with reference to a flowchart of FIG. 3, which shows a stoppability improvement routine. In this routine, an auxiliary drive request value reduction process (S103) is executed if the speed of the vehicle is higher than 0 and equal to or lower than the predetermined speed a, the depression amount of the accelerator is equal to "0", and that the engine 1 is idling (YES in both S101 and S102), namely, on the condition that a shift of the engine 1 to idle operation has been made in the process of stopping the automobile from traveling. The auxiliary drive request value reduction process reduces the drive request value for the auxiliary. In the example of FIGS. 2A to 2D, as the auxiliary drive request value reduction process, the number of operations of the water-heated heaters 22 is set to "0" to reduce the drive request value for the alternator 7 as one of the auxiliaries (at the timing T1).

It is then determined, based on the surface information stored in the RAM of the electronic control unit 20, whether the automobile is traveling on a road surface with low friction coefficient (FIG. 3: step S104). The road surface information is stored into the RAM according to, for example, the following method. That is, a reference acceleration as a theoretical acceleration on a standard road surface for the automobile to run on is calculated from a throttle opening degree, a vehicle speed, a change gear ratio, and the like during acceleration of the automobile. If the actual acceleration is smaller than the reference acceleration by a value equal to or larger than a predetermined criterial acceleration, it is determined that the automobile is currently traveling on a road surface with low friction coefficient, and the information is stored into the RAM. An alternative method may be adopted that includes the steps of calculating a difference between the rotational speed of the driving wheels 6 and the rotational speed of the driven wheels during acceleration of the automobile, estimating that the automobile is currently traveling on a road surface with low friction coefficient if the difference is equal to or larger than a predetermined criterial rotational speed, and storing the information in the RAM.

If it is determined in step S104 that the automobile is traveling on a road surface with low friction coefficient, it is determined whether a time point corresponding to the start of reduction of the drive request value for the auxiliary has arrived (S105). Then, if the time point corresponding to the start of reduction of the drive request value for the auxiliary has arrived, a target engine speed reduction process (S106) for reducing the target engine speed by a value equivalent to the reduction in the drive request value for the auxiliary is executed. In the example of FIGS. 2A to 2D, the target engine speed is reduced by the value equivalent to the reduction in the drive request value, from the time point corresponding to the start of reduction of the drive request value for the alternator 7 (the timing T1). Further, if it is determined in step S104 of FIG. 3 that the automobile is not traveling on a road surface with low friction coefficient, it is determined whether a time point after the lapse of a delay time from the time point corresponding to the start of reduction of the drive request value for the auxiliary has arrived (S107). If it is determined that that time point has arrived, the target engine speed reduction process (S106) is executed. In the example of FIGS. 2A to 2D, the target engine speed is reduced by the value equivalent to a reduction in the drive request value, from the time point (T2) after the lapse of the delay time (T1~T2) from the start of reduction of the drive request value for the alternator 7.

On the other hand, if a negative determination is made in step S101 of FIG. 3, it is determined whether the speed of the vehicle is "0" and the automobile has been stopped (S108). When a positive determination is made here, an auxiliary drive request value recovery process (S110) is executed if the drive request value for the auxiliary is being reduced (S109: YES). The drive request value for the auxiliary is recovered to a pre-reduction value thereof as a result of this process. After that, a target engine speed recovery process (S111) is executed, and the target engine speed has recovered to a pre-reduction value thereof. In the example of FIGS. 2A to 2D, the auxiliary drive request value recovery process (S110) and the target engine speed recovery process (S111) are performed at time T3. The number of operations of the water-heated heaters 22 is then increased from "0" to "2" through the auxiliary drive request value recovery process (S110), and the drive request value for the alternator 7 is recovered to the pre-reduction value thereof. In addition, as the drive request value for this alternator 7 is recovered, the target engine speed is recovered to the pre-reduction value thereof through the target engine speed recovery process (S111).

According to the first embodiment of the invention described above in detail, the following effect is obtained. If the automobile is traveling on a road surface with low friction coefficient upon a shift of the engine 1 to idle operation in the process of stopping the automobile from traveling, the target engine speed is reduced by a value equivalent to a reduction in the drive request value for the auxiliary, from a time point corresponding to the start of reduction of the drive request value. Thus, the automobile is swiftly stopped from traveling without stalling the engine 1. Further, if the automobile is not traveling on a road surface with low friction coefficient, the target engine speed is reduced by a value equivalent to a reduction in the drive request value for the auxiliary after the lapse of a delay time from a time point corresponding to the start of reduction of the drive request value. Thus, the engine 1 is prevented from stalling due to the reduction of the target engine speed at a premature timing. Owing to the foregoing process, the automobile may be swiftly stopped while restraining the engine 1 from stalling upon a shift of the engine 1 to idle operation in the process of stopping the automobile from traveling.

Next, the second embodiment of the invention will be described with reference to FIGS. 4A to 4D. When the drive request value for the auxiliary is large upon a shift of the engine 1 to idle operation in the process of stopping the automobile, the target engine speed is also high. Therefore, the drive request value for the auxiliary is reduced rapidly and drastically, and the target engine speed is also reduced rapidly and drastically on the basis of reduction of the drive request value. In this case, if the drive rate of the auxiliary cannot be reduced in good response to a drastic reduction in the drive request value for the auxiliary, reducing the target engine speed by a value equivalent to the reduction in the drive request value before the lapse of a delay time, when the automobile is traveling on a road surface with low friction coefficient, may cause the engine 1 to stall. That is, high rotational resistance is produced in the engine 1 to drive the auxiliary during a period in which there is a response delay in reduction of the drive rate of the auxiliary. When the target engine speed is drastically reduced at once by the value equivalent to the drastic reduction in the drive request value for the auxiliary in such a state, the engine 1 may stall.

In the second embodiment of the invention, modifications are added to the mode of implementation of the auxiliary drive request value reduction process (S103 in FIG. 3) and the mode of implementation of the target engine speed reduction process (S106 in FIG. 3) of the first embodiment of the invention in order to cope with the above described problem. The modified parts will be described hereinafter in detail with reference to time charts of FIGS. 4A to 4D.

Figures 4A, 4B, 4C, 4D:
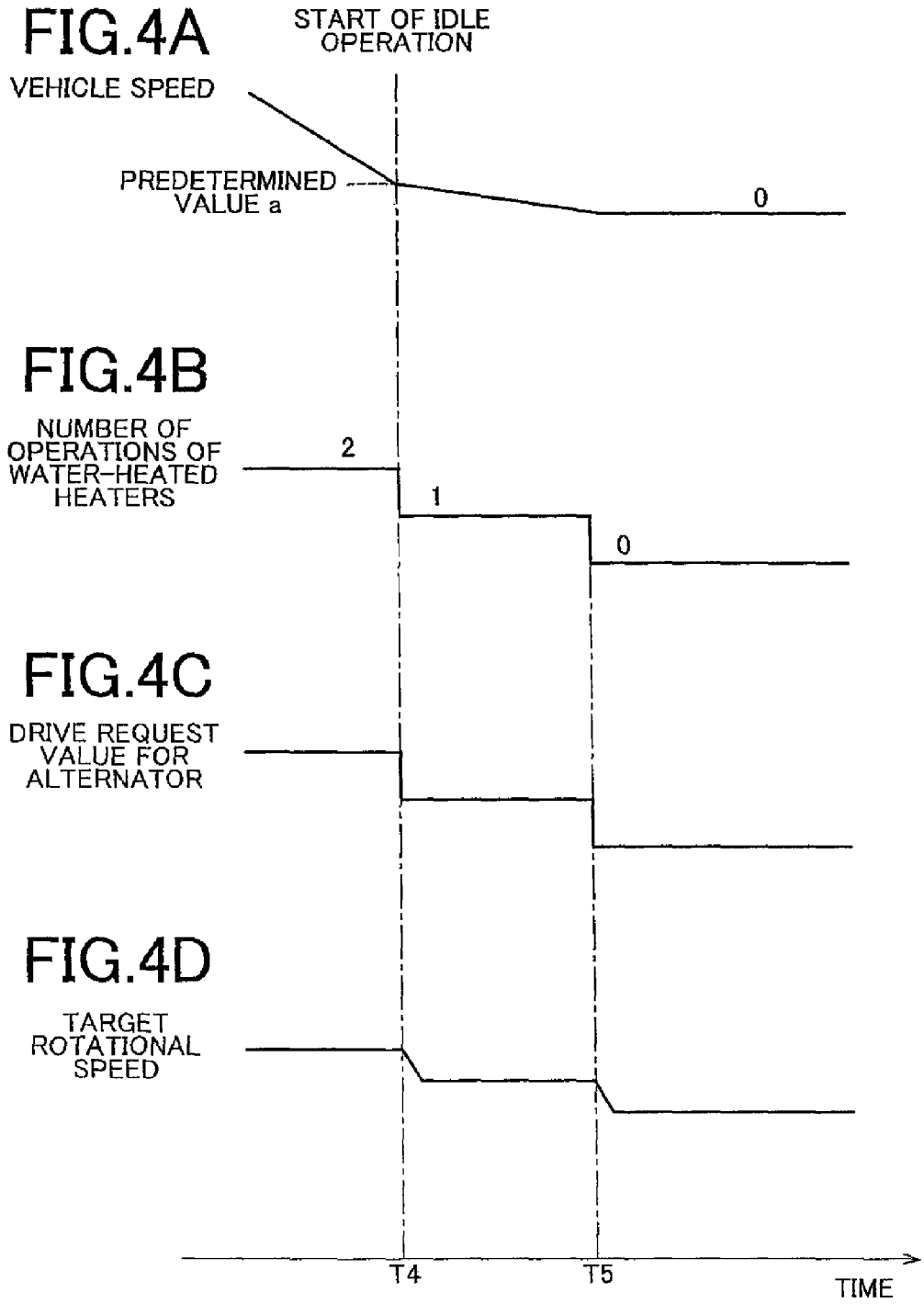
FIGS. 4A to 4D are time charts showing changes in vehicle speed, number of operations of water-heated heaters, driving request value for an alternator, and target rotational speed respectively when bringing an automobile from traveling to a stop in the second embodiment of the invention.

When the speed of the vehicle is equal to or lower than the threshold vehicle speed a as shown in FIG. 4A to make a shift of the engine 1 to idle operation in the process of stopping the automobile from traveling, the drive request value for the auxiliary is gradually (in a stepwise fashion) reduced as the auxiliary drive request value reduction process. In the example of FIG. 4B, all the (two) water-heated heaters 22 are in operation, and the number of operations of the water-heated heaters 22 is gradually (in a stepwise fashion) reduced as shown in FIG. 4B under a situation where the drive request value for the alternator 7 is large. More specifically, the number of operations is reduced from "2" to "1" at time T4 and then from "1" to "0" at time T5. As a result, the drive request value for the alternator 7 is also gradually (in a stepwise fashion) reduced as shown in FIG. 4C in accordance with the reduction in the number of operations of the water-heated heaters 22. The period of time between time T4 and T5 may be longer than the delay time (e.g., 3 seconds).

If the automobile is traveling on a road surface with low friction coefficient when the drive request value reduction process is executed, the target engine speed is reduced by a value equivalent to a reduction in the drive request value for the auxiliary (the alternator 7), from time points (T4, T5) corresponding to the start of reduction of the drive request value. In the example of FIGS. 4A to 4D, when the number of operations of the water-heated heaters 22 is reduced from "2" to "1" at time T4, the target engine speed is reduced by a value equivalent to a resultant reduction in the drive request value for the alternator 7. In addition, when the number of operations of the water-heated heaters 22 is reduced from "1" to "0" at time T5, the target engine speed is reduced by a value equivalent to a resultant reduction in the drive request value of the alternator 7. In this case, accordingly, the target engine speed is gradually (in a stepwise fashion) reduced as shown in FIG. 4D based on the reduction of the number of operations of the water-heated heaters 22.

In a situation where the drive request value for the auxiliary is large and a response delay is produced in reduction of the drive rate of the auxiliary for reduction of the drive request value, the drive request value for the auxiliary is gradually (in a stepwise fashion) reduced, and consequently, the target engine speed is also gradually (in a stepwise fashion) reduced, by executing the drive request value reduction process and the target engine speed reduction process. Thus, if there is high rotational resistance for driving the auxiliary is produced in the engine 1 during a period in which there is a response delay in reduction in the drive rate of the auxiliary for reduction of the drive request value for the auxiliary, the target engine speed can be restrained from being drastically reduced, and the engine 1 can be restrained from stalling as a result of a drastic reduction in the target engine speed.

If the automobile is not traveling on a road surface with a low friction coefficient when the auxiliary drive request value reduction process is executed, the target engine speed is reduced by a value equivalent to reductions in the drive request value for the auxiliary (the alternator 7) after the lapse of a delay time from the time points (T4, T5) corresponding to the start of reduction of the drive request value. In the example of FIGS. 4A to 4D, when the number of operations of the water-heated heaters 22 is reduced from "2" to "1" at time T4, the target engine speed is reduced by a value equivalent to a reduction in the drive request value for the alternator 7 resulting from the reduction in the number of operations after the lapse of the delay time from time T4. In addition, when the number of operations of the water-heated heaters 22 is reduced from "1" to "0" at time T5, the target engine speed is reduced by a value equivalent to a reduction in the drive request value for the alternator 7 resulting from the reduction in the number of operations after the lapse of the delay time from time T5.

According to the second embodiment of the invention, the following effect is obtained in addition to that described in the first embodiment of the invention. In a situation where the drive request value for the auxiliary is reduced through the auxiliary drive request value reduction process when the drive request value is large whereby a response delay is caused in reduction of the drive rate of the auxiliary, the drive request value for the auxiliary and the target engine speed are reduced as follows. That is, the drive request value for the auxiliary is gradually (in a stepwise fashion) reduced through the auxiliary drive request value reduction process. Consequently, the target engine speed is also gradually (in a stepwise fashion) reduced through the target engine speed reduction process. Thus, when high rotational resistance for driving the auxiliary is produced in the engine 1 during a period in which there is a response delay in reduction of the drive rate of the auxiliary for reduction of the drive request value for the auxiliary, the target engine speed is restrained from being reduced drastically, and the engine 1 is restrained from stalling as a result of a drastic reduction in the target engine speed.

Mentionable as the situation where the drive request value for the auxiliary is large is a situation where the number of operations of the water-heated heaters 22, which require a large amount of power, is large and the drive request value for the alternator 7 is large. Under such a situation, the number of operations of the water-heated heaters 22 is gradually (in a stepwise fashion) reduced to reduce the drive request value for the alternator 7 as the drive request value reduction process, and the target engine speed is likewise gradually (in a stepwise fashion) reduced in accordance with the reduction of the number of operations through the target rotational speed reduction process. Accordingly, when high rotational resistance for driving the alternator 7 is produced in a period in which there is a response delay in reducing the drive rate of the alternator 7 due to reduction of the drive request value for the alternator 7, the target engine speed is not drastically reduced. Thus, stalling of the engine 1 as a result of a drastic reduction in the target engine speed may be avoided.

The foregoing respective embodiments of the invention may also be modified, for example, as follows. In the second embodiment of the invention, the target engine speed may be gradually (in a stepwise fashion) reduced through the target rotational speed reduction process on the basis of a reduction in the drive rate of the alternator 7 (power generation amount) in gradually (in a stepwise fashion) reducing the number of operations of the water-heated heaters 22 through the auxiliary drive request value reduction process. In this case as well, an effect similar to that of the foregoing second embodiment of the invention is obtained.

In each of the first embodiment of the invention and the second embodiment of the invention, the target engine speed is reduced on a road surface with low friction coefficient, from the time point corresponding to the start of reduction of the drive request value for the auxiliary through the auxiliary drive request value reduction process. However, it is also possible to make a modification such that the target engine speed is reduced before the lapse of the delay time and after the time point corresponding to the start of reduction of the drive request value. In this case, an effect similar to that of the first embodiment of the invention is obtained.

The drive request value for the auxiliary may be reduced through the auxiliary drive request value reduction process by stopping a component other than the water-heated heaters 22. Such components may include, for example, an electric motor for a power steering device, an electric wire for windows, a compressor for an air-conditioner, or the like.

The delay time may be set to a value other than 3 seconds. The invention may also be applied to a front-wheel-drive automobile. However, a more desirable effect is achieved if the invention is applied to a rear-wheel-drive automobile as shown in each of the described embodiments of the invention. This is related to the fact that a braking force exerted by a brake acting on rear wheels is set smaller than a braking force exerted by a brake acting on front wheels in an automobile from the standpoint of posture stability in the process of stopping the automobile from traveling through the braking forces of the brakes. That is, in the rear-wheel-drive automobile, the braking force exerted by the brake acting on the rear wheels as driving wheels is small, and a driving force applied to the driving wheels if the engine 1 is idling as the automobile is being brought to a halt tends to be larger than the braking force exerted by the brake acting on the driving wheels. Therefore, it tends to take some time to stop the automobile from traveling. By applying the invention to the rear-wheel-drive automobile, which has this characteristic, a more desirable effect is achieved.

The invention may be applied to an automobile equipped with a negative pressure brake booster that assists the depression of a brake using negative pressure generated in the intake system of the engine 1. In this case, a more desirable effect is achieved. When the engine 1 is idling, the negative pressure generated in the intake system of the engine 1 tends to become equal to a value on the atmospheric pressure side. In this state, the brake booster does not provide much assistance in the depression of the brake, and the braking force applied to the driving wheels decreases. That is, in an automobile equipped with a negative pressure brake booster, when the engine 1 shifts to idle operation in the process of stopping the automobile from traveling, the braking force exerted by the brakes acting on the driving wheels tends to decrease, and the driving force applied to the driving wheels as a result of the idle operation tends to exceed the braking force. Therefore, it tends to take some time to stop the automobile from traveling. By applying the invention to the automobile equipped with the negative pressure brake booster, which has this characteristic, a more desirable effect is achieved.

The engine 1 may execute the engine idle speed control by adjusting the opening degree of an idle speed control valve provided in a bypass passage that bypasses the throttle valve 12.

The engine 1 may be a diesel engine in which the engine idle speed is controlled by adjusting the fuel injection amount.

The invention claimed is:

1. A control apparatus for an internal combustion engine mounted on a vehicle that executes an engine idle speed control for adjusting the engine speed to a target engine speed set in accordance with a magnitude of a drive request value for an auxiliary driven by the internal combustion engine when a vehicle speed is equal to or below a predetermined speed to idle the internal combustion engine, when stopping the vehicle from traveling, reduces the drive request value for the auxiliary when executing the engine idle speed control, and reduces the target engine speed by a value equivalent to a reduction in the drive request value after lapse of a prescribed delay time from a time point corresponding to start of reduction of the drive request value, the control apparatus comprising:

a detection device that determines whether the vehicle is traveling on a road surface with low friction coefficient; and an engine speed reduction device that reduces the target engine speed by the value equivalent to the reduction in the drive request value before lapse of the delay time if it is determined that the vehicle is traveling on a road surface with low friction coefficient.

2. The control apparatus according to claim 1, wherein the engine speed reduction device reduces the target engine speed by the value equivalent to the reduction in the drive request value for the auxiliary, from the time point corresponding to start of reduction of the drive request value.

3. The control apparatus according to claim 1, wherein the engine speed reduction device reduces the target engine speed by the value equivalent to the reduction in the drive request value for the auxiliary after the start of reduction of the drive request value and before lapse of the delay time.

4. The control apparatus according to claim 1, wherein the engine speed reduction device gradually reduces the drive request value for the auxiliary, and also gradually reduces the target engine speed in a manner corresponding to reduction of the drive request value.

5. The control apparatus according to claim 4, wherein the auxiliary is an alternator that generates power in accordance with a number of electric heaters in operation, and gradually reduces the number of the electric heaters in operation to reduce the drive request value for the alternator, and the engine speed reduction device gradually reduces the target engine speed based on the reduction of the number of the electric heaters in operation.

6. The control apparatus according to claim 4, wherein the auxiliary is an alternator that generates power in accordance with a number of electric heaters in operation, and gradually reduces the number of the electric heaters in operation to reduce a drive request value for the alternator, and the engine speed reduction device gradually reduces the target engine speed based on the reduction in a drive rate of the alternator resulting from the reduction in the drive request value.

7. The control apparatus according to claim 1, wherein the engine speed reduction device reduces the drive request value for the auxiliary in a stepwise fashion, and also reduces the target engine speed in a manner corresponding to reduction of the drive request value in a stepwise fashion.

8. The control apparatus according to claim 1, wherein the auxiliary is at least one of an electric motor for a power steering device, a heating element for windows, and a compressor for an air conditioner.

9. A control method for an internal combustion engine mounted on a vehicle, wherein an engine idle speed control is executed to adjust the engine speed to a target engine speed set in accordance with a magnitude of a drive request value for an auxiliary driven by the internal combustion engine if a vehicle speed is equal to or below predetermined speed to idle the internal combustion engine, when stopping the vehicle from traveling, the drive request value for the auxiliary is reduced when executing the engine idle speed control, and the target engine speed is reduced by a value equivalent to a reduction in the drive request value after lapse of a prescribed delay time from a time point corresponding to start of reduction of the drive request value, the control method comprising:

determining whether the vehicle is traveling on a road surface with low friction coefficient; and reducing the target engine speed by the value equivalent to the reduction in the drive request value before lapse of the delay time if it is determined that the vehicle is traveling on a road surface with low friction coefficient.

* * * * *